US006736692B1

(12) United States Patent
Hoyos-Zermeno et al.

(10) Patent No.: US 6,736,692 B1
(45) Date of Patent: May 18, 2004

(54) HAIR STYLING DOLL HEAD HAVING COLOR CHANGE HAIR CRIMPER

(75) Inventors: Laura Hoyos-Zermeno, Torrance, CA (US); Nicolae G. Patean, Rancho Cucamonga, CA (US)

(73) Assignee: Mattel, Inc., El Segundo, CA (US)

( * ) Notice: Subject to any disclaimer, the term of this patent is extended or adjusted under 35 U.S.C. 154(b) by 0 days.

(21) Appl. No.: 10/448,964

(22) Filed: May 30, 2003

(51) Int. Cl.[7] ..... A63H 3/44; A63H 3/52
(52) U.S. Cl. ..... 446/296; 446/394; 446/472
(58) Field of Search ..... 446/97, 268, 296, 446/319, 321, 394, 472

(56) References Cited

U.S. PATENT DOCUMENTS

| | | | | |
|---|---|---|---|---|
| 3,382,607 A | | 5/1968 | Ryan et al. | |
| 3,903,640 A | | 9/1975 | Dunn | |
| 4,257,188 A | | 3/1981 | Barker | |
| 4,421,560 A | | 12/1983 | Kito et al. | |
| 4,781,647 A | | 11/1988 | Doane, Jr. | |
| 4,826,550 A | | 5/1989 | Shimizu et al. | |
| 4,874,345 A | | 10/1989 | Dirks | |
| 5,011,445 A | | 4/1991 | Nakasuji et al. | |
| 5,083,967 A | | 1/1992 | Yokoe et al. | |
| 5,085,607 A | | 2/1992 | Shibahashi et al. | |
| 5,116,277 A | * | 5/1992 | Kelley | 446/319 |
| 5,180,325 A | | 1/1993 | Eddins et al. | |
| 5,411,800 A | | 5/1995 | Yokoe et al. | |
| 5,503,583 A | | 4/1996 | Hippely et al. | |
| 5,607,338 A | | 3/1997 | Landi | |
| 5,716,253 A | | 2/1998 | Aoki et al. | |
| 5,842,905 A | | 12/1998 | Lee et al. | |
| 5,848,599 A | * | 12/1998 | Todd | 132/221 |
| 6,280,281 B1 | * | 8/2001 | Unalp | 446/75 |
| 6,468,088 B1 | | 10/2002 | Fujita et al. | |

FOREIGN PATENT DOCUMENTS

| | | |
|---|---|---|
| EP | 0 292 907 | 11/1988 |
| EP | 0 347 022 | 12/1989 |
| FR | 2 627 398 | 2/1988 |
| GB | 2 205255 A | 12/1988 |
| JP | 6-71053 | 3/1994 |
| JP | 6-304340 | 11/1994 |
| JP | 10-118341 | 5/1998 |
| JP | 10-201960 | 8/1998 |
| JP | 11-309275 | 11/1999 |
| JP | 11-323664 | 11/1999 |
| JP | 2001-38064 | 2/2001 |
| WO | WO 89/08486 | 9/1989 |

* cited by examiner

*Primary Examiner*—Jacob K. Ackun
(74) *Attorney, Agent, or Firm*—Roy A. Ekstrand

(57) ABSTRACT

A doll head is supported by a body portion and includes a quantity of posable thermochromic reactive hair strands. A crimper includes a pair of liquid receiving heads and crimping dies allowing the crimper to assume a desired temperature and impart a desired crimp to the poseable hair strands while simultaneously imparting a desired temperature to achieve color change of the crimped hair. The crimping dies are removable from the heads of the crimper to facilitate straightening of the hair using underlying flat thermally conductive plates on the interior surfaces of the crimpers heads.

5 Claims, 3 Drawing Sheets

HAIR STYLING DOLL HEAD HAVING COLOR CHANGE HAIR CRIMPER

FIELD OF THE INVENTION

This invention relates generally to hair play for dolls and particularly to hair play involving color change.

BACKGROUND OF THE INVENTION

Perhaps one of the most common activities indulged in by young children in playing with dolls is that which utilizes some form of hair play. As used in the toy art, hair play embraces various activities such as grooming, styling or cutting the dolls hair. Also embraced with the term hair play is the utilization of various articles of ornamentation such as hair clips and the like.

Within the hair play activities provided by practitioners in the art, hair styling has become an extremely exciting and creative aspect due in part to the creation of hair fibers, which are described, as "posable". Such fibers have been largely the result of developments in synthetic materials with particular attention to cold temperature setting characteristics. The wide variety of thermoplastic materials having suitably high molecular weights for utilization in posable hair fibers has contributed greatly to the development of hair play toys.

For example, U.S. Pat. No. 5,234,370 issued to Shapero et al. sets forth a POSABLE DOLL HAIR AND METHOD OF MANUFACTURE FOR THE SAME in which a posable hair is formed of an amorphous thermoplastic material having a relatively high molecular weight. The compound includes plasticizers, heat stabilizers and lubricants.

U.S. Pat. No. 5,180,325 issued to Eddins et al. sets forth a POSABLE HAIR STRAND FOR TOY DOLL including a ductile and formable center core fiber and an outer casing surrounding the center core. The center core fiber preferably includes a multifilament yarn fiber which is impregnated with a relatively soft formable wax material.

U.S. Pat. No. 3,382,607 issued to Ryan et al. sets forth a FIGURE TOY HAVING FIBERS IMPREGNATED WITH INDICATOR DIE in which a doll includes portions such as hair impregnated with an indicator die capable of repeated and reversible color change in response to contact with liquids of different pH concentrations.

U.S. Pat. No. 3,903,640 issued to Dunn sets forth a CHANGEABLE HAIR DOLL having two sections of simulated hair of differing characteristics secured to opposite sides of a rotatably mounted hemispherical head portions extending generally from the forehead area to the lower crown area of the head. Rotation of the hemispherical portion moves either of the two hair sections into prominence on the doll head.

U.S. Pat. No. 4,781,647 issued to Doane, Jr. sets forth a TOY DOLL CONSTRUCTION WITH PHOSPHORESCENT HAIR FIBERS the particle size of the phosphorescent materials within the dolls hair is carefully controlled to provide hair which is capable of "glowing in the dark".

U.S. Pat. No. 4,874,345 issued to Dirks sets forth a DOLL WITH CHANGEABLE HAIR PIECE in which a doll head includes means for releasably mounting changeable hairpieces thereon. The hairpieces include suction cup portions which snap onto the doll head to maintain a tight fit.

U.S. Pat. No. 5,607,338 issued to Landi sets forth a TOY WITH UNRAVELABLE CORD MATERIAL FOR SIMULATING HAIR OR FUR in which lengths of flexible unravelable cord material simulate hair or fur. The cord material may be unraveled into individual strands or groups of strands which simulate strands of hair.

U.S. Pat. No. 5,842,905 issued to Lee et al. sets forth a PROCESS FOR MAKING A TEMPORARY COLOR CHANGE IN A PLASTIC MATERIAL having a doll supporting a quantity of hair formed of a plastic material. A colorless but pH sensitive indicator solution is applied to the plastic doll hair without changing its color. A developer solution of a specific pH range is subsequentially applied to the doll hair causing the color of the hair to change.

A number of patents set forth various doll hair fibers having a variety of different physical properties. For example, U.S. Pat. No. 5,083,967 issued to Yokoe et al. and U.S. Pat. No. 5,411,800 also issued to Yokoe et al. set forth specific synthetic fiber compositions used in making improved doll hair similarly, European Patent Application 0,292,907 filed on behalf of Yokoe sets forth a synthetic fiber suitable for use in dolls hair consisting essentially of an acrylonitrile polymer comprising thirty to eighty by weight of an acrylonitrile polymer and seventy to twenty percent by weight of a vinyl chloride and a vinylidene chloride.

In accordance with a relatively recently emerging technology, a number of temperature sensitive color change materials and paints have been developed. Such materials have become widely used and widely known in the art. The basic function of such materials is to provide a capability for changing the color of an object or material by changing its temperature. Such color change materials often exhibit two states characterized by a clear colorless state and a color change state. Still other color change materials exhibit different opaque states of different colors in response to different temperatures. As would be expected, a substantial number of toy products using such color change materials have been provided by practitioners in the art. While the number of such products is substantial, examples are found in U.S. Pat. No. 5,716,253 issued to Aoki et al.; U.S. Pat. No. 5,503,583 issued to Hippely et al.; U.S. Pat. No. 5,085,607 issued to Shibahashi et al. and U.S. Pat. No. 4,826,550 issued to Shimizu et al. These patents are simply illustrative of a substantial body of known art which utilizes color change materials for toy products.

While the foregoing described prior art toys have to some extent improved the art and in some instances enjoyed commercial success, there remains nonetheless a continuing need in the art for evermore improved, interesting and amusing toys having hair play features.

SUMMARY OF THE INVENTION

Accordingly, it is a general object of the present invention to provide an improved hair play doll. It is a more particular object of the present invention to provide an improved hair play doll having a color change feature associated therewith. It is a still more particular object of the present invention to provide an improved hair play doll which combines the interest of color change capability together with the activities associated with hair styling and crimping.

In accordance of the present invention there is provided

BRIEF DESCRIPTION OF THE DRAWINGS

The features of the present invention, which are believed to be novel, are set forth with particularity in the appended claims. The invention, together with further objects and advantages thereof, may best be understood by reference to the following description taken in conjunction with the accompanying drawings, in the several figures of which like reference numerals identify like elements and in which:

DESCRIPTION OF THE PREFERRED EMBODIMENTS

Figure 1:
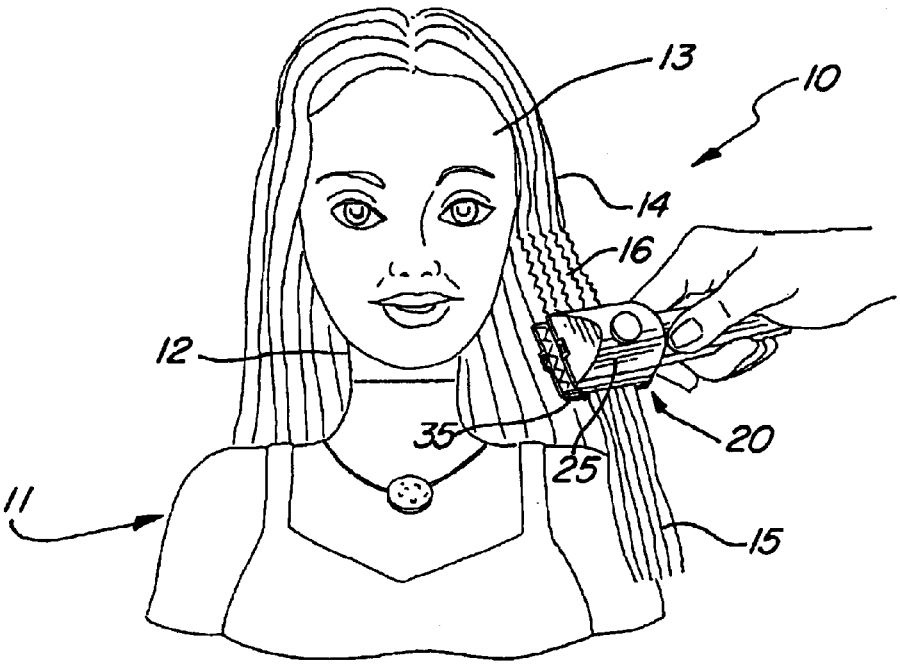
FIG. 1 sets forth a front view of a hair play doll and associated hair crimper constructed in accordance with the present invention.

FIG. 1 sets forth a hair styling doll head constructed in accordance with the present invention and generally referenced by numeral 10 together with a color change hair crimper also constructed in accordance the present invention and generally referenced by numeral 20. Hair styling doll 10 includes an upper body 11 and a neck portion 12 supporting a doll head 13. In the preferred fabrication of the present invention, hair styling doll head 10 which includes the combination of upper body portion 11, neck 12 and head 13 is approximately child's size in order to facilitate hair styling by the child user. However, it will be apparent to those skilled in the art that the present invention is equally applicable to complete dolls of different sizes. Head 13 of doll head 10 supports a quantity of hair 14 including a hair bundle 15. In the preferred fabrication of the present invention, hair 14 is fabricated of a color change material utilized in combination with a material which allows the hair to be somewhat "posable". The quality of posability in hair is known in the art and is described in the above prior art such as the above-mentioned U.S. Pat. No. 5,234,370 issued to Shapiro et al. Similarly, the use of thermochromic materials for various types of toys including dolls is also well known in the art and is for example described in the above mentioned U.S. Pat. No. 5,503,583 issued to Hippely et al. While a variety of thermochromic materials and thermochromic inks and paints may be utilized for obtaining color change characteristic for hair 14, the preferred fabrication for doll head 10 utilizes a thermochromic material manufactured by Pilot Inc. under the part number CC-212-5. The characteristic of this thermochromic material results in a parting a color change characteristic to hair 14 which assumes a blond color when subject to warm temperatures and a pink color when subjected to cold temperatures. Again, it will be understood by those skilled in the art that other thermochromic materials and other colors may be utilized for hair 14 without departing from the spirit and scope of the present invention.

Crimper 20 is constructed in accordance with the present invention and described below in greater detail. However, suffice it to note here that crimper 20 is utilized in a handheld manner as illustrated in FIG. 1 and opens in an action similar to a conventional set of tongs. Thus, crimper 20 will be understood to include a pair of handles 21 and 31 supporting respective heads 25 and 35 (best seen in FIG. 2). As is also better seen in FIGS. 2 through 4 and described below, crimper 20 further supports a pair of crimping dies 40 and 41 upon the inside mating surfaces of the head portions of crimper 20. Suffice it to note for illustration in FIG. 1, is the ability of crimper 20 to opened and thereafter closed upon a bundle of hair such as hair bundle 15. The user then imparts a squeezing motion to crimper 20 to produce a succession of hair crimped portions such as crimped portions 16.

In addition to hair crimping, and is accordance with an advantage of the present invention, crimper 20 includes interior cavities within heads 25 and 35 which facilitate the retention of a liquid such as water at a desired temperature. For example, the interior of heads 25 and 35 may be filled with warm water to induce a color change in hair bundle 15 as it is exposed to crimper 20 which produces a blond hair color change within hair 14. Conversely, the retention of cold water within heads 25 and 35 causes crimped portion 16 to assume a pink color characteristic due to the exposure to the cooled crimper heads of crimper 20.

In this manner, the child user is able to simultaneously style or crimp the hair upon doll head 10 while imparting a localized color change thereto. As is described below in FIG. 5 in greater detail, crimper 20 may also be configured to produce a hair flattening or "uncrimping" action which removes previously curled or crimped portions of the hair being styled. In further accordance with the present invention, the removal of the crimping heads from hair crimper 20 does not remove the temperature color induces color change characteristic as the hair is squeezed between the heads of crimper 20. Thus, during both crimping and flattening operations, crimper 20 may impart the desired thermochromic color change to the hair being styled.

Figure 2:
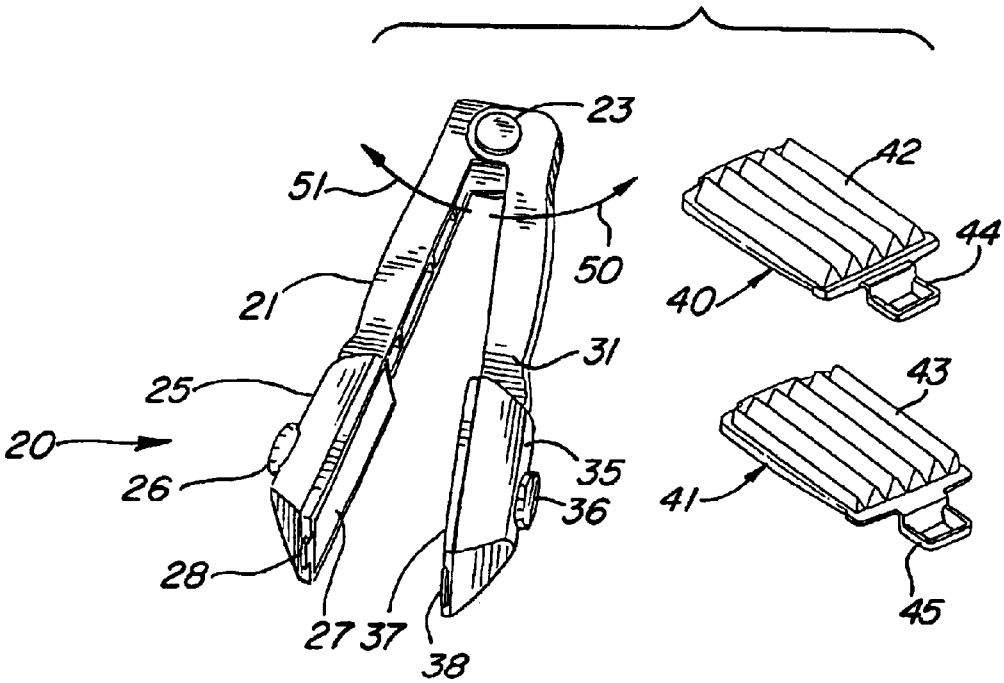
FIG. 2 sets forth a perspective assembly view of the hair crimper shown in FIG. 1 and constructed in accordance with the present invention.

FIG. 2 sets forth a perspective assembly view of hair crimper 20. In the view shown in FIG. 2, the pair of crimping dies 40 and 41 are removed from head portions 25 and 35 respectively of crimper 20. Thus, crimper 20 is shown in FIG. 2 to be configured in accordance with its use as a hair-flattening accessory.

More specifically, crimper 20 includes a pair of molded plastic handles 21 and 31 joined at a pivot 23. Accordingly, handles 21 and 31 are pivotally movable with respect to each other about pivot 23. Handle 21 supports a head 25 while handle 31 supports a head 35. In further accordance with the present invention, head 25 includes a tab 28 which is utilized in the manner described below for removably securing crimping die 40 to head 25. Also in further accordance with the present invention, and as is described below in greater detail, head 25 includes a removable cap 26 which is utilized for introducing a quantity of liquid such as water into the interior of head 25. A metal plate 27 is supported on the interior surface of head 25 and is in thermal contact with the interior liquid within head 25 in the manner shown in FIG. 3.

Figure 3:
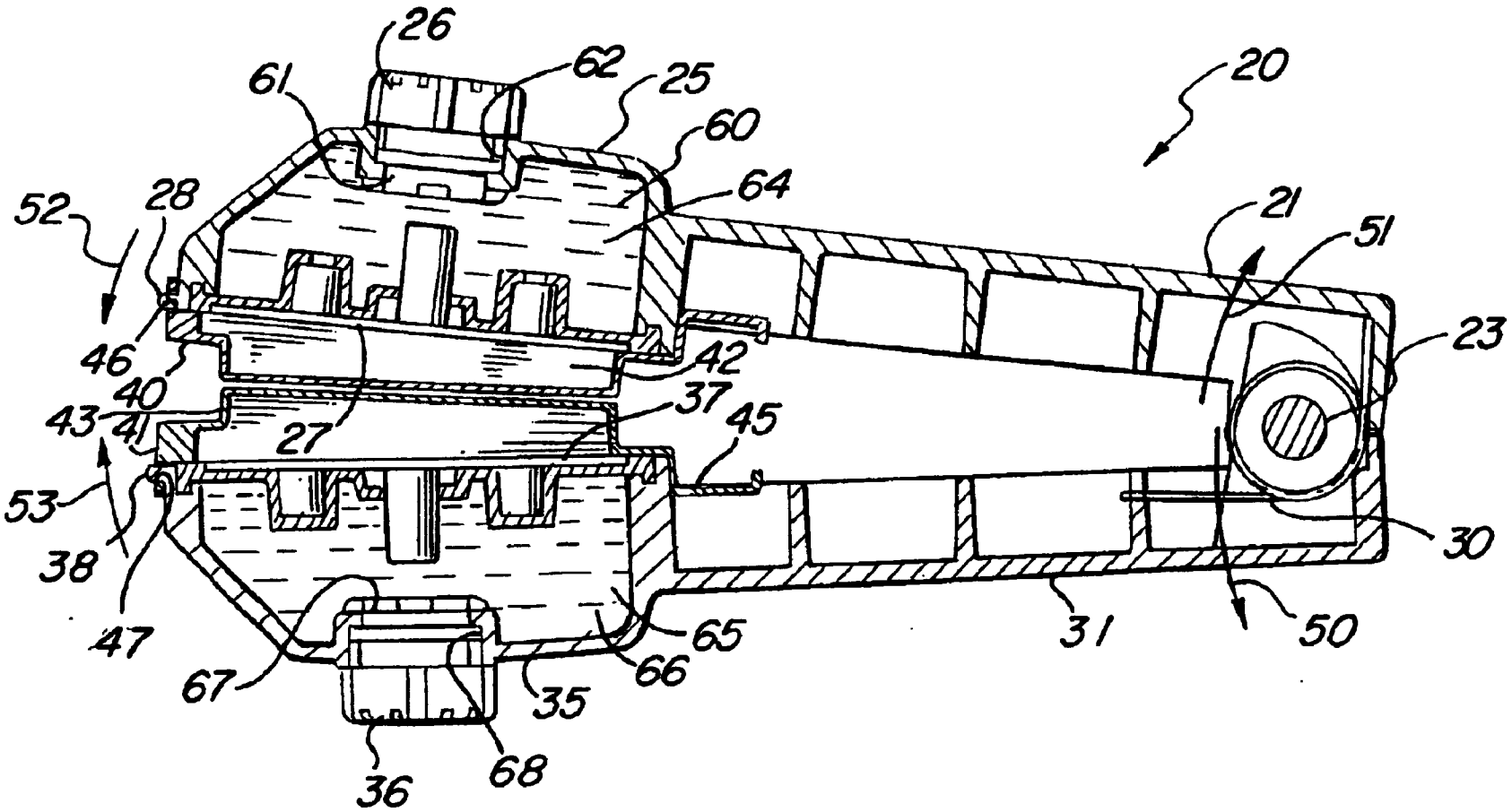
FIG. 3 sets forth a section view of the hair crimper utilized in the present invention hair play doll.

Similarly, head 35 defines an interior cavity also shown in FIG. 3, having an access cap 36 for introducing a suitable temperature liquid into head 35. Head 35 includes a tab 38 utilized in removably securing crimping die 41 to head 35. While not seen in FIG. 2 due to the perspective view shown, head 35 will be understood to include a metal plate 37 on the interior surface thereof. As is better seen in FIG. 3, plate 37 is in thermal contact with the liquid interior of head 35.

Crimping dies 40 and 41 are substantially identical and are removably attachable to heads 25 and 35 respectively. Thus, crimping die 40 is formed of a metal or other thermal conductive material and includes a plurality of generally parallel triangular crimping ridges 42. Crimping die 40 further includes a slot 46 (seen in FIG. 3) which receives tab 28 to removably secure crimping die 40 to head 25. In addition, crimping die 40 includes a snap tab 44 which, in the manner shown in FIG. 3, cooperates to maintain the attachment of crimping die 40 to head 25.

In a virtually identical construction, crimping die 41, also formed of a metal or other thermally conductive material, includes a slot 47 (seen in FIG. 3) together with an attachment snap tab 45. Crimping die 41 defines a complimentary set of triangular shaped crimping ridges 43. Ridges 42 and 43 of dies 40 and 41 are configured to interlace or interleave when dies 40 and 41 are pressed together. An illustration of this crimping action is set forth below in FIG. 4.

Figure 4:
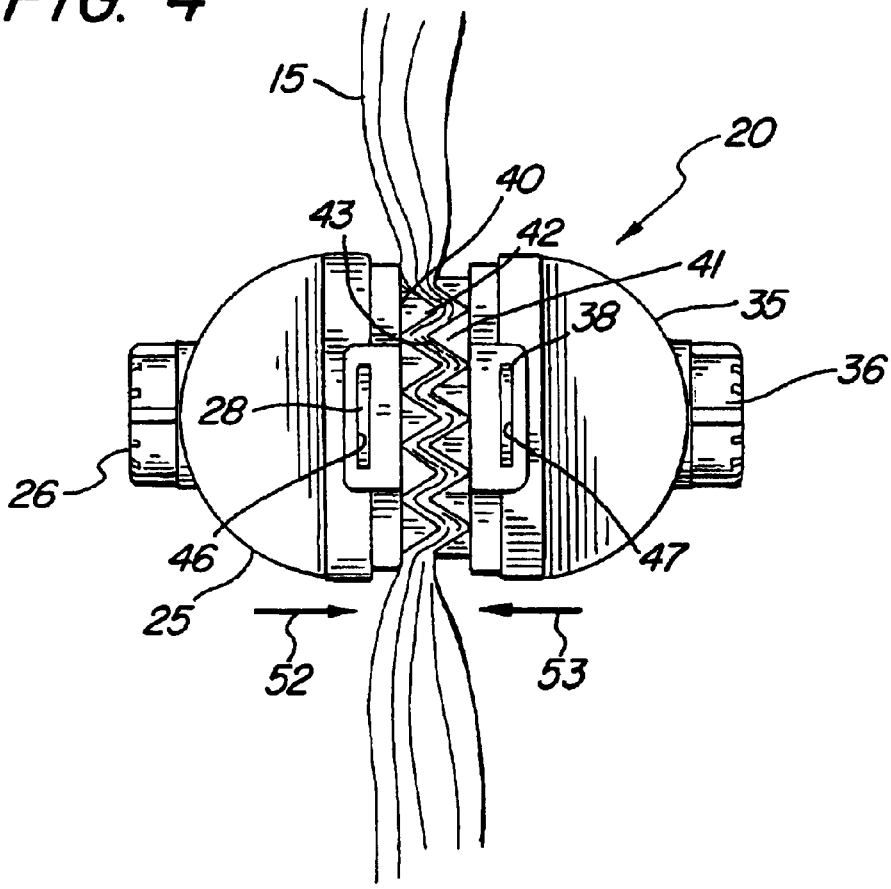
FIG. 4 sets forth an end view of the hair crimper of the present invention hair play doll in a typical hair crimping application.

Hair crimper 20 may be configured from its hair flattening configuration shown in FIG. 2, to the crimping configuration shown in FIGS. 3 and 4 by simply snap-fitting crimping dies 40 and 41 upon plates 27 and 37 of heads 25 and 35 respectively. This snap-fit attachment is carried forward by simply inserting tabs 28 and 38 into the respective slots of crimping dies 40 and 41 and thereafter forcing snap tabs 44 and 45 against the rear surfaces of heads 25 and 35. In accordance with the preferred fabrication of the present invention, the attachment of crimping dies 40 and 41 against plates 27 and 37 provides thermal conductive contact there between. As a result, the heated or cooled liquid within heads 25 and 35 imparts a temperature change through plates 27 and 37 to crimping dies 40 and 41.

FIG. 3 sets forth a section view of crimper 20. As described above, crimper 20 is preferably formed of pair of generally mirror image molded plastic handles 21 and 31. Handles 21 and 31 are pivotally joined at a pivot 23. In addition, a spring 30 is secured at pivot 23 and exerts a separating force against handles 21 and 31 urging handles 21 and 31 outwardly in the directions indicated by arrows 50 and 51. Handle 21 further supports a hollow crimping head 25. Head 25 defines an interior cavity 60 having a clip recess 62 and an aperture 61 formed therein. A removable cap 26 is received within cap recess 62 in a sealing engagement to provide closure and liquid tight integrity for interior cavity 60. Head 25 further includes a metal plate 27 secured to the interior side of head 25 and providing closure of interior cavity 60. Plate 27 is formed of a metal or other thermal conducting material and is secured to the remainder of head 25 by conventional attachment such as adhesive attachment or the like. Of importance with respect to the operation of crimper 20 is the thermal conductivity provided between plate 27 and a quantity of liquid 64 within interior cavity 60. Crimping die 40 described above includes a slot 46 which receives tab 28 of head 25 to secure one side of crimping die 40. Crimping die 40 further includes a snap tab 44 which secures the opposite side of crimping die 40 to head 25 in a snap fit attachment. As described above, crimping die 40 include a plurality of generally parallel triangular ridges 42.

Similarly, handle 31 supports a head 35 having an interior cavity 65 formed therein. Head 35 further includes a cap recess 68 and an aperture 67. A sealing cap 36 is received within cap receptacle 68. Head 35 further includes a plate 37 which completes interior cavity 65. Plate 37 is formed of a metal or other thermally conductive material and is secured to head 35 by conventional attachment such as adhesive attachment or the like. Head 35 further defines a tab 38 extending outwardly. Head 35 further supports a crimping die 41 having a slot 47 formed therein. Slot 47 receives tab 38 to secure one end of crimping die 41. The remaining end of crimping die 41 is secured to head 35 by a snap tab 45. Crimping die 41 includes a plurality of generally parallel triangularly shaped crimping ridges 43. As described above, ridges 42 of crimping die 40 and ridges 43 of crimping die 41 are spaced to interleave when crimping dies are brought together during the hair crimping action. A quantity of liquid 66 is received within interior cavity 65.

In operation, the desired temperature is created within heads 25 and 35 by removing caps 26 and 36 respectively and filling interior cavities 60 and 65 respectively with a liquid such as water at the desired temperature. Thereafter, caps 26 and 36 provide closure of interior cavities 60 and 65 of heads 25 and 35. The temperature of liquid within each of heads 25 and 35 is conducted to plates 27 and 37 respectively to crimping dies 40 and 41 respectively. At this point, hair crimper 20 is configured for simultaneous hair crimping and color change play activity. Spring 30 urges handles 21 and 31 outwardly in the directions indicated by arrows 50 and 51 to an open position. Accordingly, during hair play a quantity of hair is placed between crimping dies 40 and 41 in the manner shown in FIG. 1. Thereafter, the user squeezes handles 31 and 21 together overcoming the force of spring 30 and moving crimping dies 40 and 41 inwardly in the direction indicated by arrows 52 and 53. The crimping dies mesh upon the hair bundle in the manner shown in FIG. 4 imparting a physical crimp to the hair strands and applying the desired temperature to the thermochromic color change hair. As a result, a single crimping action changes the hair color and imparts the desired crimp to the hair. Thereafter, the user releases handles 31 and 21 allowing spring 30 to again open crimper 20 and the user may then utilize crimper 20 upon a different portion of the hair bundle or upon a different hair segment. This process may be continued so long as the user desires to impart a particular color change and crimp to the hair being styled.

At any point during the process, the user may reverse the color change activity by removing the liquid from the interiors of heads 25 and 36 and replacing it with a different temperature material. Subsequent crimping using the newly replaced liquid at a different temperature will reverse the color change process and the apparent color of the crimped hair.

FIG. 4 sets forth an end view of crimper 20 during an illustrative crimping and color change operation. As described above, crimper 20 includes a pair of opposed inwardly facing heads 25 and 35 having respective caps 26 and 36 providing closure thereof. As is also described above, heads 25 and 35 include respective tabs 28 and 38 which are utilized in securing a pair of crimping dies 40 and.41 between heads 25 and 35. More specifically, crimping die 40 includes a slot 46 which receives tab 28 for attachment of one end of crimping die 40. Similarly, crimping die 41 includes a slot 47 which receives tab 38 of head 35. Crimping dies 40 and 41 define respective triangularly shaped crimping ridges 42 and 43. As can be seen in FIG. 4, ridges 42 and 43 of crimping dies 40 and 41 are offset to facilitate meshing or interlocking of the ridges as crimping dies 40 and 41 are pressed together in the direction indicated by arrows 52 and 53.

A bundle of hair 15 is captivated between crimping dies 40 and 41 as heads 25 and 35 are squeezed together. During this process, the posable character of hair bundle 15 allows the hair to become temporarily posed or crimped into the pattern determined by ridges 42 and 43. In addition, as the squeeze is maintained upon hair bundle 15, the temperature of the hair bundle is altered by the captivated liquid within heads 25 and 35 (shown in FIG. 3) causing the desired color change to take place. Thereafter, the user releases the squeezing action of crimper 20 and the above-described spring separates heads 25 and 35 releasing hair bundle 15. The released hair bundle will assume the crimp and the desired color characteristic.

Figure 5:
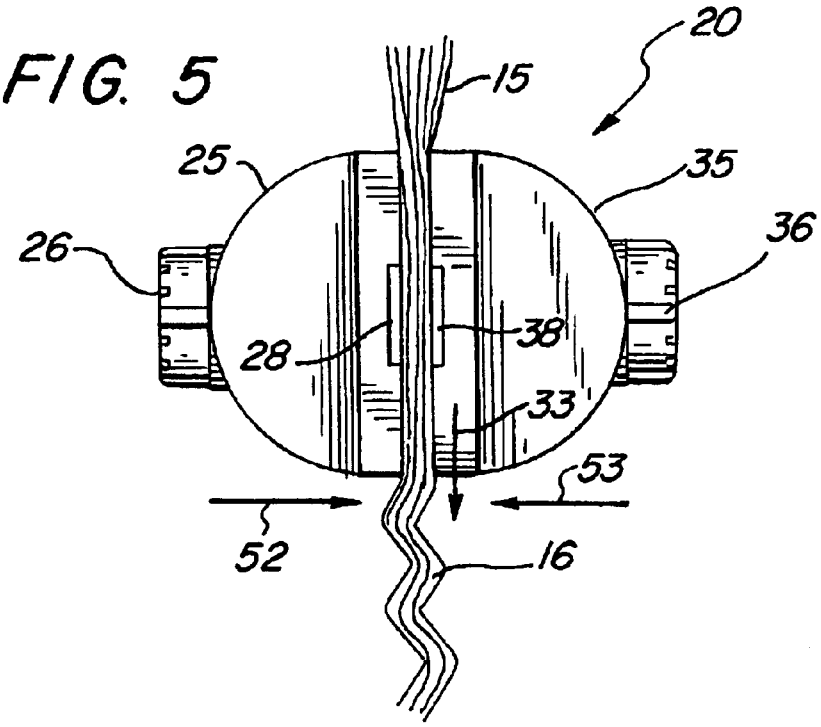
FIG. 5 sets forth an end view of the hair crimping device of the present invention hair play doll configured to flatten or remove crimp from the doll hair.

FIG. 5 sets forth an end view of crimper 20 during the hair flattening process. As described above, crimper 20 is useable without crimping dies 40 and 41 which may be removes by simply unsnapping tabs 44 and 45 and removing crimping dies 40 and 41 (seen in FIGS. 2 and 3). With crimping dies 40 and 41 removed, heads 25 and 35 may be squeezed together upon a previously crimped hair bundle 15 having a crimped and color change portion 16. It will be recalled that in the absence of crimping dies 40 and 41 upon heads 25 and 35, plates 27 and 37 (seen in FIG. 3) face inwardly within heads 25 and 35 respectively. Plates 27 and 37 are generally planar and thus may be used to flatten the hair bundle as heads 25 and 35 are squeezed together in the directions indicated by arrows 52 and 53. In addition, the above described temperature characteristic for heads 25 and 35 may be utilized in the absence of crimping dies 40 and 41 to produce a desired color change. In the anticipated use of hair crimper 20 without crimping dies 40 and 41, heads 25 and 35 are squeezed together and crimper 20 is moved downwardly in the direction indicated by arrow 33 to flatten or straighten previously crimped hair portion 16. Simultaneously, the liquid within heads 25 and 35 may impart a desired color change to hair bundle 15.

What has been shown is a novel hair styling doll head having color change hair crimper which is utilized to provide a styling and hair change capability. This simultaneous styling and color change capability imparts an increased enjoyment and amusement to the color change and styling process of the inventive doll and crimper.

While particular embodiments of the invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention.

That which is claimed:

1. A hairplay toy comprising:

a doll head;

a quantity of posable doll hair upon said doll head, said posable doll hair having a first color at a first temperature and a second color at a second temperature;

a crimper having first and second crimping heads and means for moving said crimping heads between open and closed positions;

first and second liquid-receiving cavities within said first and second crimping heads; and first and second crimping dies secured to said first and second crimping heads, said crimper operative to enable a user to squeeze a portion of said doll hair between said crimping dies and thereby impart a crimp and color change to said portion of said doll hair.

2. The hairplay toy set forth in claim 1 wherein said crimping heads include first and second thermally conductive plates in thermal communication with said first and second liquid-receiving cavities.

3. The hairplay toy set forth in claim 2 wherein said first and second crimping heads and crimping dies include first and second removable attachment means for removably securing said crimping dies.

4. The hairplay toy set forth in claim 3 wherein said first and second thermally conductive plates and said first and second crimping dies are each formed of metal.

5. The hairplay toy set forth in claim 4 wherein said crimper is operative in an alternate configuration having said crimping dies removed from said crimping heads.

* * * * *